US009918548B2

(12) United States Patent
Lee

(10) Patent No.: US 9,918,548 B2
(45) Date of Patent: Mar. 20, 2018

(54) MULTITIER COLLAPSIBLE STAND

(71) Applicant: Harry Kai Lee, Pomona, CA (US)

(72) Inventor: Harry Kai Lee, Pomona, CA (US)

( * ) Notice: Subject to any disclaimer, the term of this patent is extended or adjusted under 35 U.S.C. 154(b) by 0 days.

(21) Appl. No.: 15/089,884

(22) Filed: Apr. 4, 2016

(65) Prior Publication Data

US 2017/0280869 A1 Oct. 5, 2017

(51) Int. Cl.
*A47B 9/00* (2006.01)
*A47B 43/00* (2006.01)
*A47B 81/06* (2006.01)

(52) U.S. Cl.
CPC ..... *A47B 43/00* (2013.01); *A47B 81/06* (2013.01)

(58) Field of Classification Search
CPC ..... A47B 43/00; A47B 81/06
USPC ..... 108/176
See application file for complete search history.

(56) References Cited

U.S. PATENT DOCUMENTS 7,337,732 B2 * 3/2008 Becker ..... A47B 43/00 108/115
7,913,863 B2 * 3/2011 Lin ..... A47B 81/06 211/186
8,015,930 B2 * 9/2011 Huang ..... A47B 43/00 108/115
8,015,931 B2 * 9/2011 Lin ..... A47B 43/00 108/115
8,136,462 B2 * 3/2012 Lin ..... A47B 43/00 108/193
9,451,824 B1 * 9/2016 Lee ..... A47B 81/06
9,591,922 B1 * 3/2017 Lee ..... A47B 43/00
2003/0183600 A1 * 10/2003 Straka ..... B65D 9/18 217/13
2009/0194648 A1 * 8/2009 Fridley ..... A47B 81/06 248/158
2011/0017692 A1 * 1/2011 Marietta ..... A47B 43/00 211/195
2011/0292304 A1 * 12/2011 Ma ..... F16M 11/00 348/836
2012/0007484 A1 * 1/2012 Tsai ..... A47B 43/00 312/262
2012/0319546 A1 * 12/2012 Liu ..... A47B 43/00 312/237

* cited by examiner

*Primary Examiner* — Daniel J Troy
*Assistant Examiner* — Timothy M Ayres
(74) *Attorney, Agent, or Firm* — Tommy SF Wang; Wang IP Law Group, P.C.

(57) ABSTRACT

A multitier collapsible stand provides enhanced lateral stability while supporting an object, such as a television, on multiple tiers, and also presents an aesthetic décor that enhances the appearance of the object. The stand utilizes a collapsible support frame that supports multiple tiers of support panels in a tiered relationship. The support frame also collapses for enhanced portability and stowage. The support frame comprises three arms that are traversed by a pair of cross bars for enhanced structural integrity. A rear panel positions coplanar to the arms. Left and right lateral members hingedly join the arms to the rear panel. The lateral members carry multiple support panels. A hinge enables hinged articulation between arms, lateral members, and the rear panel for collapsing the stand. A buckle hinge allows for hinged articulation and separation between arms, lateral members, and the rear panel for collapsibility. An attachable vertical stand supports a television.

8 Claims, 9 Drawing Sheets

MULTITIER COLLAPSIBLE STAND

FIELD OF THE INVENTION

The present invention relates generally to a multitier collapsible stand. More so, the multitier collapsible stand provides enhanced lateral stability while supporting an object and presents an aesthetic décor through the use of a folding support frame that supports multiple tiers of shelves in a stacked, spaced-apart relationship and easily collapses for enhanced portability and stowage; whereby the support frame hinges into the collapsed position through the use of hinges and also buckle hinges that enable hinged articulation of the support frame up to 90° and separation of the components of the support frame for facilitated collapsibility, disassembly, and assemblage.

BACKGROUND OF THE INVENTION

It is known that a wide variety of entertainment centers, stands, and support brackets are available for holding television sets at a desired height and orientation. However, the use of generally available cabinet or shelf type stands, or entertainment centers or wall support brackets is not always best for bedroom viewing for a variety of reasons. Often there is lack of floor space to accommodate this type of furniture. The height of the shelves or top of a stand can be too high or too low for comfortable viewing and these usually are not adjustable. Electrical receptacles may not be conveniently located and unsightly electrical cords and antenna cables many times cannot readily be hidden from view. Further, when smaller screen television sets are used with conventional stands, they may be too far away from the bed for comfortable viewing.

Many rooms have several seating areas where it would be desirable to sit and view a television. Although the seating areas are desirable, it is often difficult or a nuisance to reposition the television each time a different seating area is selected. It would be a benefit, therefore, to have a television stand that included a motor driven turntable upon which a television could be position that could be operated to position the screen of the television in the desired viewing direction.

Typically, a television is a telecommunication medium used for transmitting moving images and sound. The television can transmit images that are monochrome, in color, or in three dimensions. Generally, one type of television—a flat screen television—is lighter and thinner than traditional television sets and video displays that use cathode ray tubes. However, the flat screen television does not have a wide base to rest on, and thus, requires an external support for adjustable positioning and viewing.

Various brackets, mounts, and tables exist for flat screen televisions. One such support is a Flat Display Mounting Interface (FDMI). The FDMI is a family of standards defined by the Video Electronics Standards Association for mounting flat panel monitors, TVs, and other displays to stands or wall mounts. It is generally implemented on most modern flat-panel monitors and televisions.

Additionally, inexpensive stands for the flat screen television are available. However, often these stands, which require user stand, often are not well designed with the thought of television dimensions and weight in mind. For example, the stands are often constructed of lightweight, inexpensive materials that are not conducive to stability. Furthermore, venting of the component heat is often poor, and may result in obvious holes and vents which detract from the aesthetic appeal of these stands. Additionally management of the considerable number of cables is typically an afterthought.

Better quality stands have improved appearance but may still not be carefully designed for home entertainment systems. For example fixed shelves do not take into account component size which often requires varying shelf clearance. Furthermore these stands can take a considerable amount of time to assemble. Even stand for store display of the stand can be an issue as employee labor rates are high and time is often of the essence during new store openings and busy selling seasons. Additionally, stand of the stands may require many stand steps and proper orientation of parts.

Often, television stands, and supportive furniture structures in general, are shipped in a fully-assembled condition from a manufacturer to a retailer and then carried off by an end user to a home or office. Consequently, the television stands is generally bulky, cumbersome and difficult to transport in a space-efficient manner. That is to say, a fully-assembled television stands consumes relatively large shipping space during transport to a retailer. Similarly, the end user may need to have available a specially-sized vehicle should he wish to carry the television stand to the home or office. The inefficient shipment of the television stand between the manufacturer and end user often results in inconvenience as well as significantly higher transportation costs which are commonly passed through to the purchaser.

Other proposals have involved folding television stands. The problem with these devices is that they do not provide a multitier, stable stand that can support the weight of the television, nor are the hinges for folding the stand sufficiently detachable and pivotal.

Thus, an unaddressed need exists in the industry to address the aforementioned deficiencies and inadequacies. Even though the above cited methods for television stands meets some of the needs of the market, a multitier collapsible stand provides enhanced lateral stability while supporting an object and presents an aesthetic décor through the use of a folding support frame that supports multiple tiers of shelves in a stacked, spaced-apart relationship and easily collapses for enhanced portability and stowage; whereby the support frame hinges into the collapsed position through the use of hinges and also buckle hinges that enable hinged articulation of the support frame up to 90° and separation of the components of the support frame for facilitated collapsibility, disassembly, and assemblage is still desired.

SUMMARY OF THE INVENTION

The present invention is directed to a multitier collapsible stand that provides enhanced lateral stability while supporting an object on multiple tiers, and also presents an aesthetic décor that enhances the appearance of the object. The multitier collapsible stand, hereafter, "stand" utilizes a collapsible support frame that supports multiple tiers of shelves in a stacked, spaced-apart relationship. The support frame also collapses for enhanced portability and stowage.

In some embodiments, the stand may include elongated arms, cross bars, lateral members, and a rear panel that hingedly interconnect to form a support frame. These components are configured to hingedly interconnect through at least one hinge and at least one buckle hinge for efficient manipulation between an expanded position and a collapsed position. The use of a buckle hinge is unique in that it enables both pivoting and partial detachment for the components of the support frame. Thus, the buckle hinge enables the arms, cross bars, and lateral members to be pivoted up to 90° and separated for facilitated collapsibility, disassembly, and assemblage.

The stand also includes a first arm, a second arm, a third arm, and a pair of cross bars disposed transversely across the arms for enhancing lateral stability in the expanded position. The stand further comprises left lateral members and right lateral members that support at least three support panels, which themselves support the object. A plurality of spacers may be positioned between the lateral members and the support panels help to dampen the weight of the objects.

In one embodiment, the stand forms a foundation through a support frame. The support frame comprises a first arm that is defined by a pair of first ends; a second arm that is defined by a pair of second ends; and a third arm that is defined by a pair of third ends. The arms are generally elongated and sufficiently rigid to provide structural integrity to the support frame. In one embodiment, the first arm, the second arm, and the third arm are disposed in a generally horizontal, spaced-apart relationship.

In some embodiments, the support frame further comprises a pair of cross bars. Each cross bar fixedly attaches in a generally perpendicular disposition to a respective end of the first arm, the second arm, and the third arm. The pair of cross bars help provide structural integrity to the arms.

In some embodiments, the support frame further comprises a rear panel that is disposed in a generally coplanar relationship with the first arm, the second arm, and the third arm. The rear panel may include a generally square shaped panel disposed at the rear of the stand. The rear panel serves as a buffer against a wall behind the stand, serving as a rearward foundation for the stand. The rear panel also improves structural integrity of the support frame. Furthermore, the support frame may also integrate an attachable vertical bracket can be detachably fastened to a rear panel to hold a flat screen type television.

In some embodiments, the support frame further comprises a first left lateral member. The first left lateral member forms a hinged bridge between the first arm and the rear panel. The first left lateral member comprises a first left arm end and a first left panel end. The first left arm end is configured to hingedly engage the first arm. The first left panel end is configured to hingedly engage the rear panel.

Directly adjacent and parallel to the first left lateral member is a second left lateral member. The second left lateral member forms a hinged bridge between the second arm and the rear panel. The second left lateral member comprises a second left arm end and a second left panel end. The second left arm end is configured to hingedly engage the second arm, while the second left panel end configured to hingedly engage the rear panel.

Directly adjacent and parallel to the second left lateral member is a third left lateral member. The third left lateral member forms a hinged bridge between the third arm and the rear panel. The third left lateral member comprises a third left arm end and a third left panel end. The third left arm end is configured to hingedly engage the third arm, while the third left panel end configured to hingedly engage the rear panel.

In some embodiments, the support frame further comprises a first right lateral member. The first right lateral member forms a hinged bridge between the first arm and the rear panel. The first right lateral member comprises a first right arm end and a first right panel end. The first right arm end is configured to hingedly engage the first arm, while the first right panel end configured to hingedly engage the rear panel.

Directly adjacent and parallel to the first right lateral member is a second right lateral member. The second right lateral member forms a hinged bridge between the second arm and the rear panel. The second right lateral member comprises a second right arm end and a second right panel end. The second right arm end is configured to hingedly engage the second arm, while the second right panel end configured to hingedly engage the rear panel.

Directly adjacent and parallel to the second right lateral member is a third right lateral member. The third right lateral member forms a hinged bridge between the third arm and the rear panel. The third right lateral member comprises a third right arm end and a third right panel end. The third right arm end is configured to hingedly engage the third arm, while the third right panel end configured to hingedly engage the rear panel.

In some embodiments, the stand may utilize three support panels for directly supporting the object. The support panels are generally elongated and flat, and rest in an even disposition. In one embodiment, a first support panel is disposed to position across the first left lateral support member and the first right lateral support member. A second support panel is disposed to position across the second left lateral support member and the second right lateral support member. A third support panel is disposed to position across the third left lateral support member and the third right lateral support member. The first, second, and third support panels are disposed in a stacked, spaced-apart relationship. In essence, the support panels form a series of tiered shelves.

In some embodiments, the stand further comprises a plurality of spacers. The spacers are disposed to position along the length of the left lateral members and the right lateral members. The spacers may be positioned between the lateral members and the shelves help to dampen the weight of the objects. Thus, the spacers enable dampening of a force, such as the weight of the object, which is applied to the support panels.

In some embodiments, the stand further comprises at least one hinge. The hinge operatively connects between the arms, cross bars, and lateral supports to enable folding and extending of the components, as needed. The hinge is fixed, and thus is not configured to enable separation between components. The hinge is defined by a first hinge side configured to pivotally join with a second hinge side. The hinge comprises a first hinge side that pivotally joins a second hinge side. In one embodiment, the hinge pivots up to 90°.

In some embodiments, the hinge hingedly connects the arms to the lateral members by hingedly connecting the first arm with the first left arm end. The hinge may further be configured to hingedly connect the second arm with the second left arm end. The hinge may further be configured to hingedly connect the third arm with the third left arm end.

In some embodiments, the hinge may be configured to hingedly connect the first arm with the first right arm end. The hinge may further be configured to hingedly connect the second arm with the second right arm end. The hinge may further be configured to hingedly connect the third arm with the third right arm end.

On a different point of the support frame, the hinge works to hingedly connect the rear panel with the support members. In one embodiment, the hinge is configured to hingedly connect the rear panel with first right arm end. The hinge also hingedly connects the rear panel with the second right arm end. The hinge is also configured to hingedly connect the rear panel with the third right arm end.

In one alternative embodiment of the stand, a first extension member, a second extension member, and a third extension member are disposed to extend between their respective arms and respective right lateral members. Each right lateral member hingedly articulates about its respective extension member in relation to the arms. The extension members serve to create greater clearance for the arms while hinging about the respective right lateral members. The extension members also increase the depth of the stand, so as to accommodate larger objects, i.e., televisions.

In some embodiments, at least one buckle hinge provides unique interconnectivity between the arms, cross bars, and lateral members by forming both a hinged and detachable connections. In one possible embodiment, the buckle hinge enables both hinged movement and detachability between the various components of the support frame. Specifically, the buckle hinge is used to fasten, connect, and pivot multiple sections of the support frame relative to each other. The buckle hinge segments into two sections through a buckling mechanism. In this manner, separation and pivoting is possible by the lateral members and rear panel of the support frame.

In one embodiment, the buckle hinge hingedly connects the rear panel with the lateral members. The buckle hinge is configured to hingedly connect the rear panel first left panel end, the second left panel end, and the third left panel end. In addition to the hinging function, the buckle hinge is further configured to enable detachment of the rear panel from the first left panel end, the second left panel end, and the third left panel end. Thus, detachment of the rear panel from the first left panel end, the second left panel end, and the third left panel end through the at least one buckle hinge enables hinged manipulations for collapsing the stand.

This unique capacity of the buckle hinge to both hingedly pivot and separate is possible because of a buckling mechanism. Specifically, the buckle hinge is defined by a lip and a latching member. The latching member comprises a mounting panel, a lever, and a catch. The lever is configured to pivotally engage the catch to the lip, wherein the lip and the latching member detach and fasten through selective manipulation of the lever.

In operation, the lever is configured to pivot on the fulcrum selectively, to and from the lip, such that the catch engages and disengages from the lip. Once the catch clasps onto the generally protruding lip, a force is applied to the lever away from the lip to forcibly clamp the respective sections of the stand together. The direction of the lever may then be reversed to disengage the catch from the lip, and thereby enable separation of the respective sections of the stand.

In one exemplary embodiment, the lip is attached to the rear panel, and the latching member is fastened to the first left lateral member. The latching member pivotally fastens and detaches from the lip in a secure but adjustable manner. The latching member comprises a mounting panel, a lever, and a catch. The lever of the latching member is configured to pivot on a fulcrum to pivotally move the catch and engage the lip. In this manner, the lip catches and holds the latching member for detachable fastening. In one embodiment, the separable buckle hinge pivots up to 90°.

In operation of collapsing the stand, the first step involves manipulating the buckle hinge to separate the rear panel from the first left panel end, the second left panel end, and the third left panel end. The hinges at the arms and lateral members may then be folded inwardly to create the collapsed, substantially flat configuration of the stand. The stand is opened to an expanded position by unfolding the arms and lateral members, and attaching the rear panel with the respective panel ends through the buckle hinge.

Thus, the stand is specially configured so that the arms, cross bars, lateral members, and rear panel are hingedly and detachably connected together so that they may be quickly assembled and also disassembled and returned to the collapsed position for further storage or shipment.

One objective of the present invention is to provide a foldable television stand that utilizes at least one buckle hinges to fold, separate, and interconnect different sections of the stand, such that configuration between a collapsed position and an expanded position is possible.

Another objective is to provide a pair of cross bars that extend transversely through the arms to enhance overall lateral stability.

Another objective is to provide three tiers of support panels for enhanced support functionality and aesthetic appearance.

Another objective is to provide a greater level of portability for a multitier collapsible stand for moving and storage than non-foldable television stands.

Another objective is to provide an upright vertical bracket for fastening flat screen televisions.

Yet another objective is to enable fast collapsing for stowage without requiring tools.

Yet another objective is to attach support panels, or shelves, to the support frame for storage of television related items.

Yet another objective is to attach a vertical bracket to the rear panel for attachment of a flat screen television.

Yet another objective is to provide a cost effective television stand that is stable enough to support heavy televisions, yet also configurable to easily collapse for stowage.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
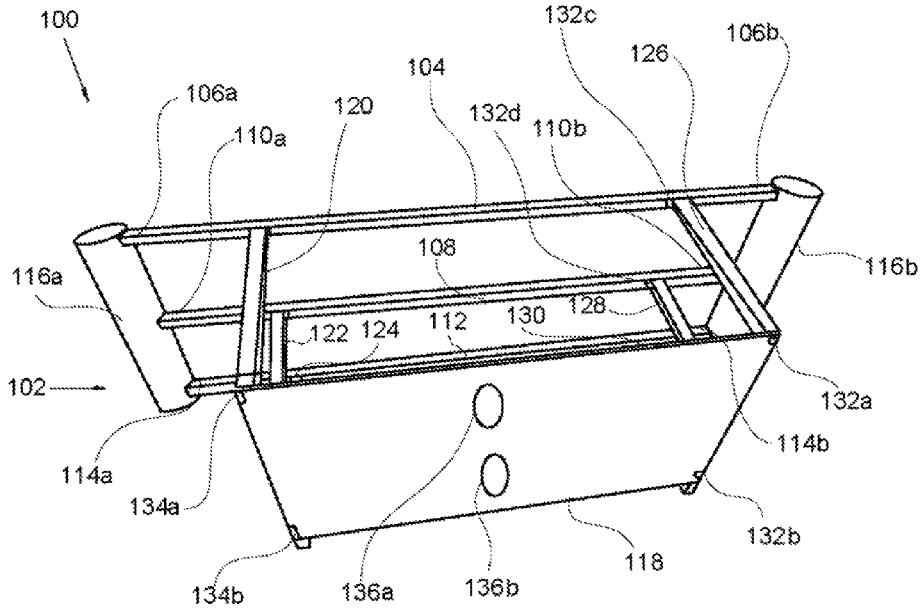
FIG. 1 illustrates a rear perspective view of an exemplary multitier collapsible stand, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-8B, a multitier collapsible stand 100 provides enhanced lateral stability while supporting an object (not shown) on multiple tiers, and also presents an aesthetic décor that enhances the appearance of the object. The multitier collapsible stand 100, hereafter, "stand 100" utilizes a collapsible support frame 102 that supports multiple tiers of support panels 150, 152, 154, or tiers, in a stacked, spaced-apart relationship. The support frame 102 also hingedly collapses for enhanced portability and stowage.

In one exemplary embodiment shown in FIG. 1, the stand 100 is configured to provide a rigid, multi-configurable support structure for supporting a television or other entertainment device, such as a flat screen television, a stereo, a computer, or a video system. The stand easily collapses for stowage, but also reversibly and easily expands for use without requiring tools or special skill. In some embodiments, the stand 100 may include a folding entertainment table for supporting a flat screen television.

In one possible embodiment, the stand 100 is a television table that supports a television while providing enhanced lateral stability and enhancing the appearance of the television through an aesthetic décor. Though in other embodiments, the stand may be used to support any number of furniture, electronic devices, tools, plants, and various objects. In other embodiments, the stand may include a folding entertainment table that can be assembled and connectible with minimal tools or skill set.

Figure 2:
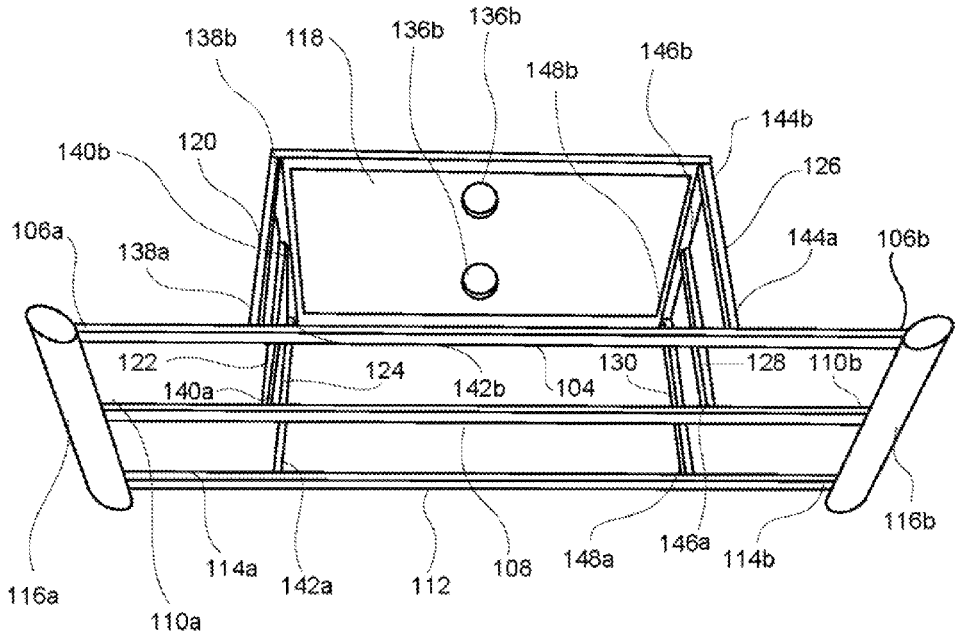
FIG. 2 illustrates a front perspective view of the multitier collapsible stand, in accordance with an embodiment of the present invention.

As FIG. 2 illustrates, the stand 100 utilizes variously disposed and sized elongated members that interconnect with hinges to construct the laterally stable and pivotally detachable configurations described below. In one possible embodiment, the stand 100 may have a generally trapezoidal shape when viewed from above, and a wide base for supporting the weight of a heavy object, such as a television. Though, the stand 100 may also take other shapes when viewed from above, such as, a rhombus, a cube, a pyramid, an oval, or a rectangle. Suitable materials for the stand 100 may include, without limitation, wood, metal, fiberglass, rigid polymers, bamboo, and cardboard.

In some embodiments, the support frame 102 may include elongated arms 104, 108, 112, cross bars 116*a*, 116*b*, lateral members 120, 122, 124, 126, 128, 130, and a rear panel 118 that hingedly interconnect to form the support frame 102 and enable hinged articulation of the support frame 102 between a collapsed position and an expanded, or operational position. These components are configured to hingedly interconnect through at least one hinge 132*a*-*g* and at least one buckle hinge 134*a*, 134*b*, 134*c* for efficient manipulation between the collapsed and expanded positions. The use of a buckle hinge 134*a* is unique in that it enables both pivoting and partial detachment for the components of the support frame 102. Thus, the buckle hinge 134*a* enables the arms 104, 108, 112, cross bars 116*a*, 116*b*, lateral members 120, 122, 124, 126, 128, 130, and the rear panel 118 to be pivoted up to 90° and separated for facilitated collapsibility, disassembly, and assemblage.

The stand 100 also includes a first arm 104, a second arm 108, a third arm 112, and a pair of cross bars 116*a*, 116*b* disposed transversely across the arms for enhancing lateral stability in the expanded position. The stand 100 further comprises left lateral members and right lateral members that support at least three support panels, which themselves support the object. A plurality of spacers 156 may be positioned between the lateral members and the support panels help to dampen the weight of the objects.

Figure 3:
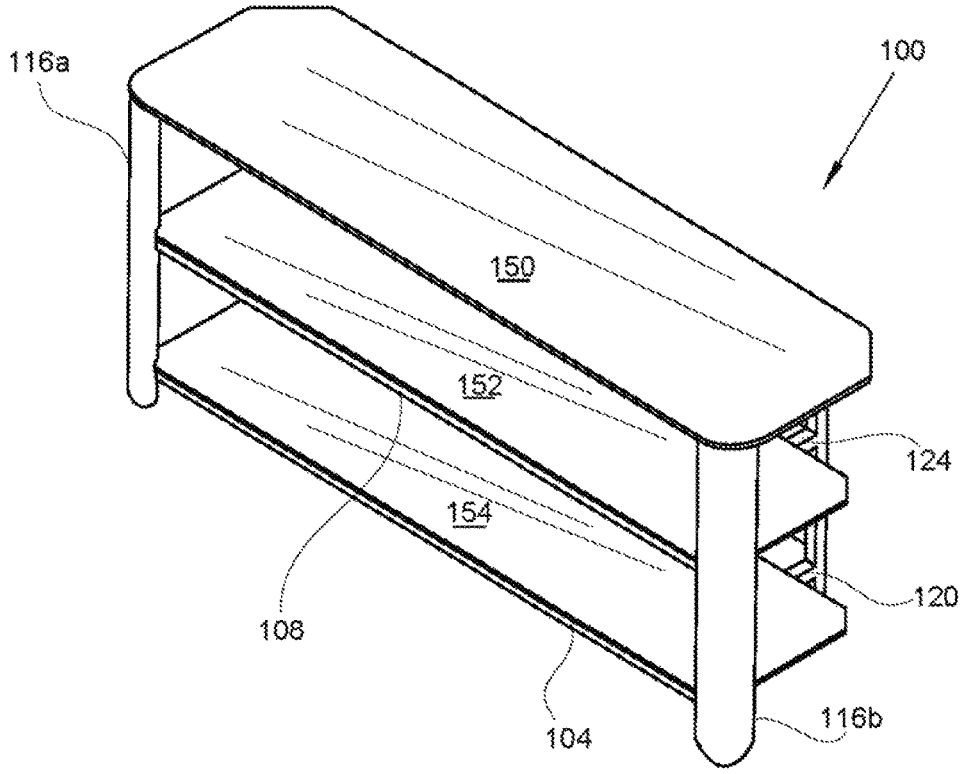
FIG. 3 illustrates a perspective view of the multitier collapsible stand with a first support panel, a second support panel, and a third support panel arranged in a tiered configuration, in accordance with an embodiment of the present invention.

Referring now to FIG. 3, the stand 100 forms a foundation through a support frame 102. The support frame 102 comprises a first arm 104 that is defined by a pair of first ends 106*a*, 106*b*; a second arm 108 that is defined by a pair of second ends 110*a*, 110*b*; and a third arm 112 that is defined by a pair of third ends 114*a*, 114*b*. The arms 104, 108, 112 are generally elongated and sufficiently rigid to provide structural integrity to the support frame 102. In one embodiment, the first arm 104, the second arm 108, and the third arm 112 are disposed in a generally horizontal, spaced-apart relationship.

In some embodiments, the support frame 102 further comprises a pair of cross bars 116*a*, 116*b*. Each cross bar 116*a*, 116*b* fixedly attaches in a generally perpendicular disposition to a respective end of the first arm 104, the second arm 108, and the third arm 112. The pair of cross bars 116*a*, 116*b* help provide structural integrity to the arms 104, 108, 112. In one embodiment, the cross bars 116*a*, 116*b* have a generally elongated cylindrical shape.

Figure 4A:
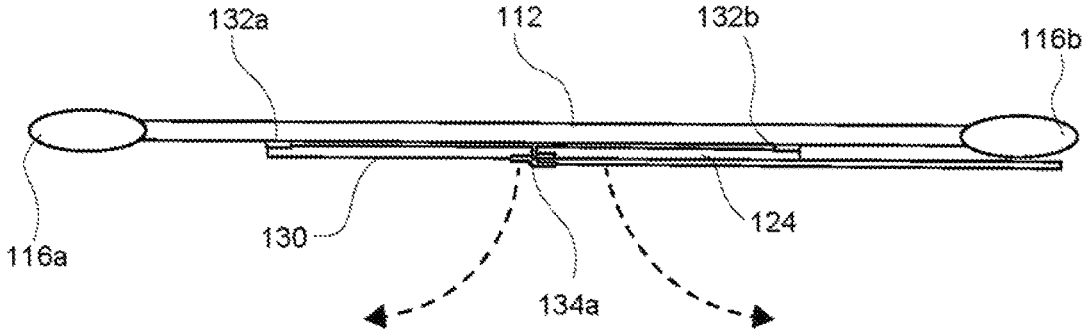
FIGS. 4A, 4B, and 4C illustrate a top view of the multitier collapsible stand hingedly articulating from a collapsed position to an expanded position, in accordance with an embodiment of the present invention.

As FIG. 4A shows, the support frame 102 further comprises a rear panel 118 that is disposed in a generally coplanar relationship with the first arm 104, the second arm 108, and the third arm 112. The rear panel 118 may include a generally square shaped panel disposed at the rear of the stand 100. The rear panel 118 serves as a buffer against a wall behind the stand 100, serving as a rearward foundation for the stand 100. The rear panel 118 also improves structural integrity of the support frame 102. In one embodiment, the rear panel 118 comprises at least one opening 136*a*, 136*b* that enables passage of wires and connectors.

In one alternative embodiment, an attachable vertical bracket 170 can be detachably fastened to the rear panel 118 to hold a flat screen type television. There are means to install additional support panels or shelves on the arms 104, 108, 112 for storage or additional entertainment components. In one embodiment, doors and windows may also be added for functionality or aesthetics.

Figure 4B:
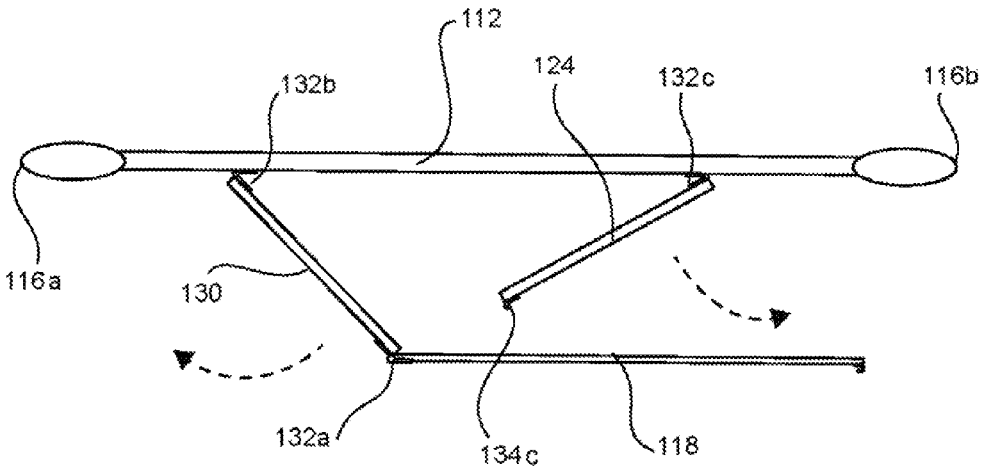

Looking now at FIG. 4B, the support frame 102 further comprises left and right lateral members 120, 122, 124, 126, 128, 130 to form a bridge between the rear panel 118 and the arms. The position of the lateral members in the center region of the stand 100 enhances lateral stability while the stand 100 is supporting the weight of an object, such as a television, in the expanded position. In one possible embodiment, the lateral members 120, 122, 124, 126, 128, 130 include a pair of parallel, spaced-apart shafts with sufficient rigidity, such that the support frame 102 does not bend, torque, or warp when a heavy weight, such as a television, is placed on the stand 100. The lateral members 120, 122, 124, 126, 128, 130 generally orient from the front to the rear of the support frame 102.

Figure 4C:
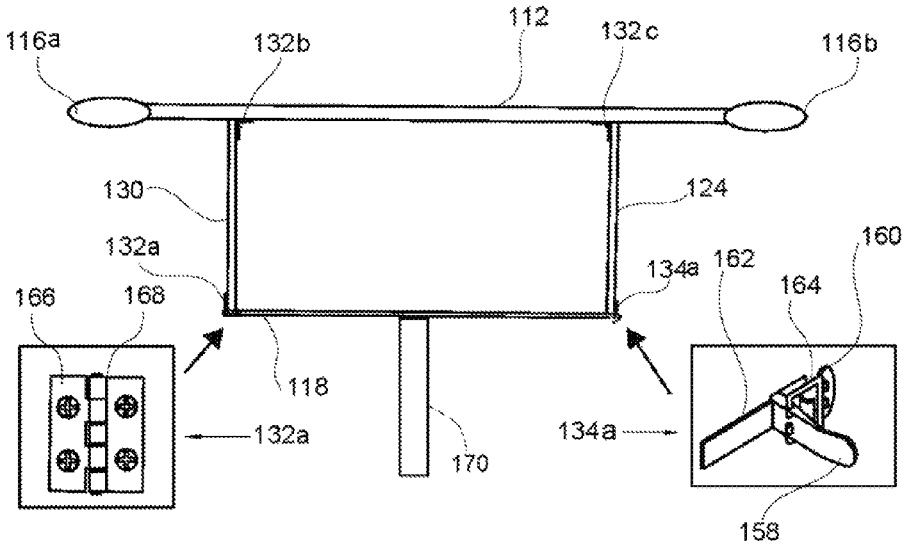

As FIG. 4C illustrates, the support frame 102 further comprises a first left lateral member 120. The first left lateral member 120 forms a hinged 132*a-f* bridge between the first arm 104 and the rear panel 118. The first left lateral member 120 comprises a first left arm end 138*a* and a first left panel end 138*b*. The first left arm end 138*a* is configured to hingedly engage the first arm 104. The first left panel end 138*b* is configured to hingedly engage the rear panel 118.

Directly adjacent and parallel to the first left lateral member 120 is a second left lateral member 122. The second left lateral member 122 forms a hinged bridge between the second arm 108 and the rear panel 118. The second left lateral member 122 comprises a second left arm end 140*a* and a second left panel end 140*b*. The second left arm end 140*a* is configured to hingedly engage the second arm 108, while the second left panel end 140*b* is configured to hingedly engage the rear panel 118.

Directly adjacent and parallel to the second left lateral member 122 is a third left lateral member 124. The third left lateral member 124 forms a hinged bridge between the third arm 112 and the rear panel 118. The third left lateral member 124 comprises a third left arm end 142*a* and a third left panel end 142*b*. The third left arm end 142*a* is configured to hingedly engage the third arm 112, while the third left panel end 142*b* configured to hingedly engage the rear panel 118.

In some embodiments, the support frame 102 further comprises a first right lateral member 126. The first right lateral member 126 forms a hinged bridge between the first arm 104 and the rear panel 118. The first right lateral member 126 comprises a first right arm end 144*a* and a first right panel end 144*b*. The first right arm end 144*a* is configured to hingedly engage the first arm 104, while the first right panel end 144*b* configured to hingedly engage the rear panel 118.

Directly adjacent and parallel to the first right lateral member 126 is a second right lateral member 128. The second right lateral member 128 forms a hinged bridge between the second arm 108 and the rear panel 118. The second right lateral member 128 comprises a second right arm end 146*a* and a second right panel end 146*b*. The second right arm end 146*a* is configured to hingedly engage the second arm 108, while the second right panel end 146*b* is configured to hingedly engage the rear panel 118.

Directly adjacent and parallel to the second right lateral member 128 is a third right lateral member 130. The third right lateral member 130 forms a hinged bridge between the third arm 112 and the rear panel 118. The third right lateral member 130 comprises a third right arm end 148*a* and a third right panel end 148*b*. The third right arm end 148*a* is configured to hingedly engage the third arm 112, while the third right panel end 148*b* is configured to hingedly engage the rear panel 118.

Looking back at FIG. 3, the stand 100 utilizes three support panels 150, 152, 154 for directly supporting the object. The support panels 150, 152, 154 are generally elongated and flat, and rest in an even disposition. In one embodiment, a first support panel 150 is disposed to position across the first left lateral member 120 and the first right lateral member 126. A second support panel 152 is disposed to position across the second left lateral member 122 and the second right lateral member 128. A third support panel 154 is disposed to position across the third left lateral member 124 and the third right lateral member 130. The first, second, and third support panels 150, 152, 154 are disposed in a stacked (tiered), spaced-apart relationship. In essence, the support panels 150, 152, 154 form a series of tiered shelves.

Figure 8A:
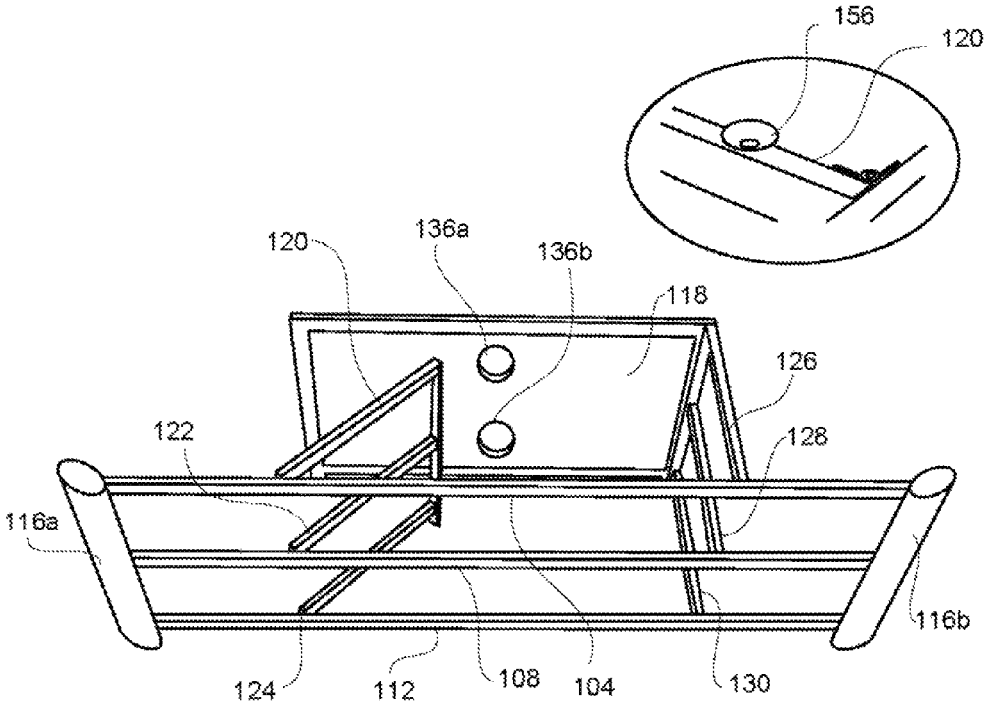
FIGS. 8A and 8B illustrate a perspective view of the multitier collapsible stand articulating in the fully expanded position, in accordance with an embodiment of the present invention.

As FIG. 8A shows in the blow up view, the stand 100 further comprises a plurality of spacers 156. The spacers 156 are disposed to position along the length of the left lateral members 120, 122, 124 and the right lateral members 126, 128, 130. The spacers 156 may be positioned between the lateral members 120, 122, 124, 126, 128, 130 and the support panels 150, 152, 154 help to dampen the weight of the object. Thus, the spacers 156 enable dampening of a force, such as the weight of the object, which is applied to the support panels 150, 152, 154.

Figure 8B:
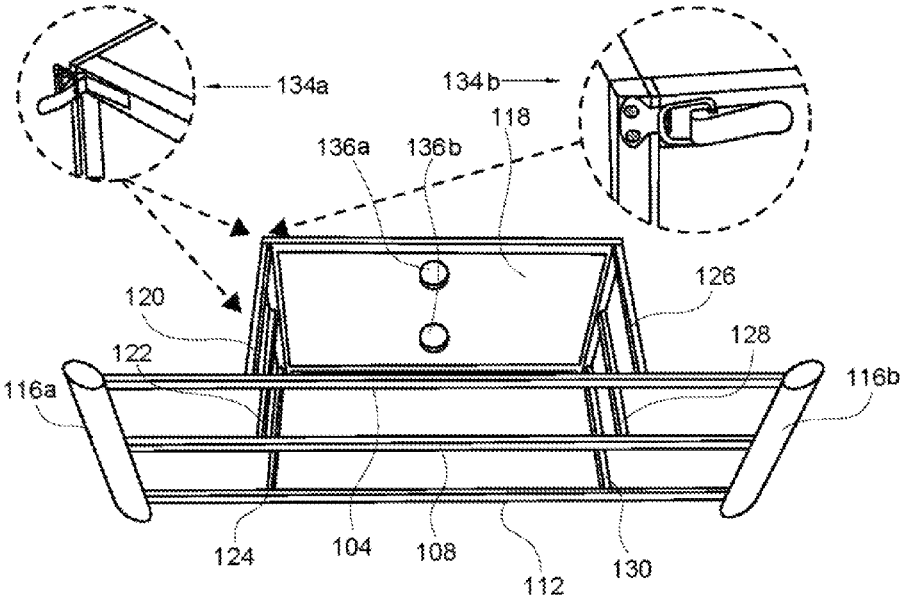

Looking now at FIG. 8B, the stand 100 further comprises at least one hinge 132*a-f*. The hinge 132*a-f* operatively connects between the arms 104, 108, 112, and the lateral members 120, 122, 124, 126, 128, 130 to enable folding and extending of the components of the support frame 102, as needed. The at least one hinge 132*a-f* is fixed, and thus is not configured to enable separation between components. The hinge 132*a-f* is defined by a first hinge side 166 that is configured to pivotally join with a second hinge side 168. In one embodiment, the hinge 132*a-f* pivots up to 90°.

Figure 5A:
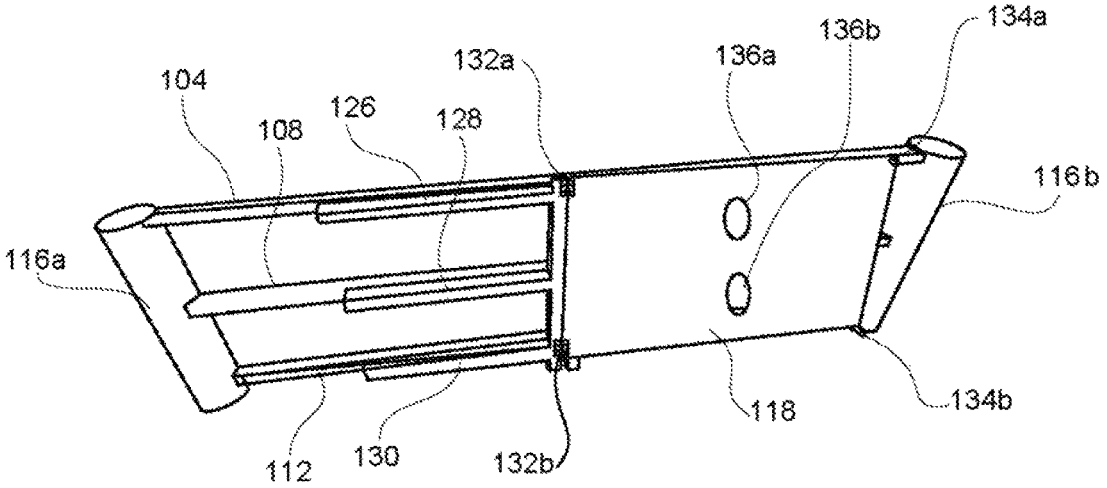
FIGS. 5A, 5B, and 5C illustrate a perspective view of the multitier collapsible stand articulating from a collapsed position to an expanded position, in accordance with an embodiment of the present invention.

Looking now at FIG. 5A, the hinge 132*a-f* is configured to hingedly connect the arms 104, 108, 112 to the lateral members 120, 122, 124, 126, 128, 130 by hingedly connecting the first arm 104 with the first left arm end 138*a*. The hinge 132*a-f* may further be configured to hingedly connect the second arm 108 with the second left arm end 140*a*. The hinge 132*a-f* may further be configured to hingedly connect the third arm 112 with the third left arm end 142*a*.

Figure 5B:
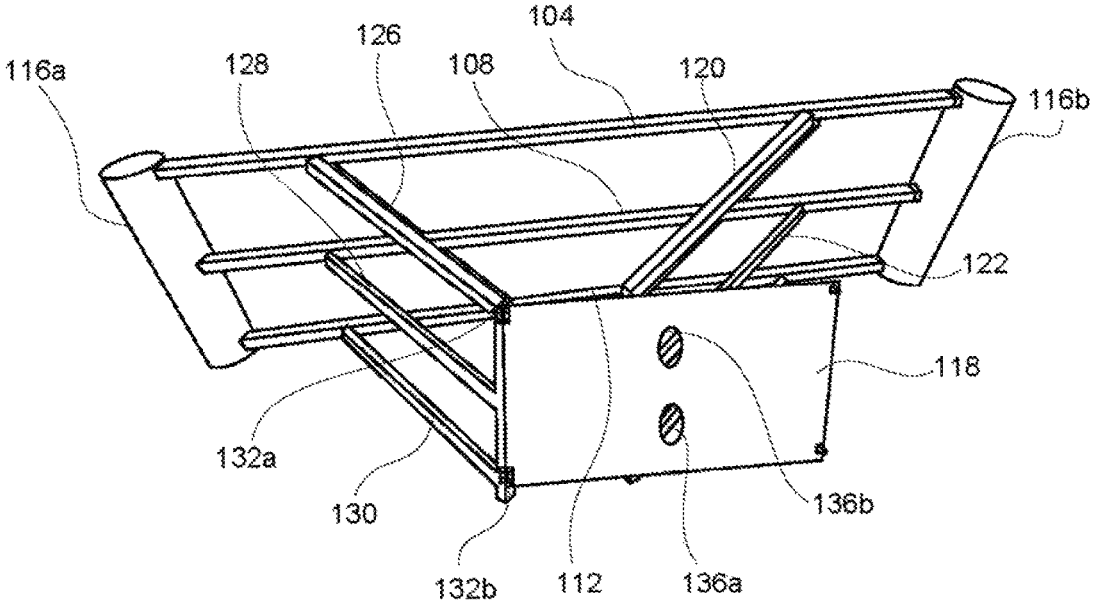

In some embodiments shown in FIG. 5B, the hinge 132*a-f* may be configured to hingedly connect the first arm 104 with the first right arm end 144*a*. The hinge 132*a-f* may further be configured to hingedly connect the second arm 108 with the second right arm end 146*a*. The hinge 132*a-f* may further be configured to hingedly connect the third arm 112 with the third right arm end 148*a*.

On a different point of the support frame 102, the hinge 132*a-f* works to hingedly connect the rear panel 118 with the support members 120, 122, 124, 126, 128, 130. In one embodiment, the hinge 132*a-f* is configured to hingedly connect the rear panel 118 with first right panel end 144*b*. The hinge 132*a-f* also hingedly connects the rear panel 118 with the second right panel end 146*b*. The hinge 132*g* is also configured to hingedly connect the rear panel 118 with the third right panel end 148*b*.

Figure 9:
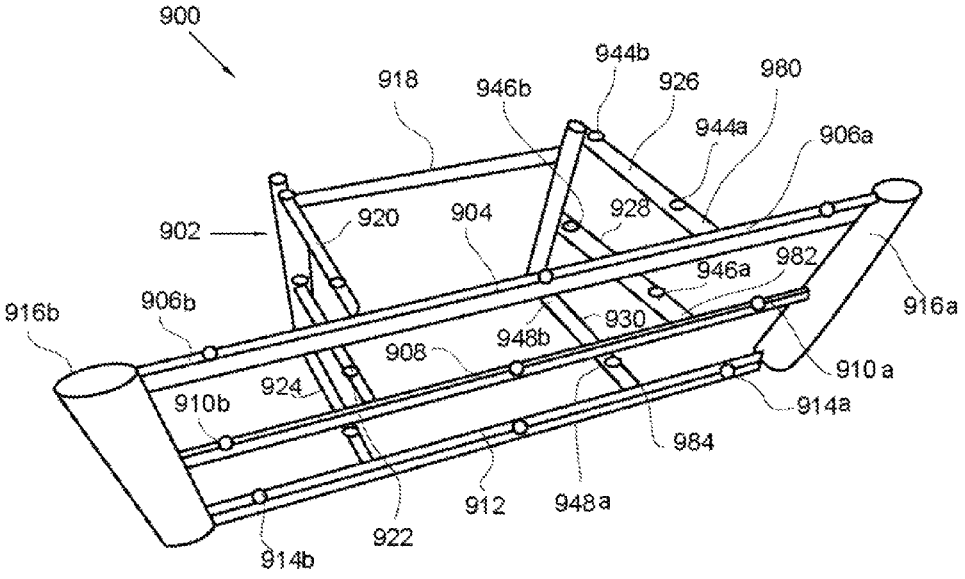
FIG. 9 illustrates a perspective view of an alternative embodiment of the multitier collapsible stand, where an extension member is disposed to extend between the arms and the right lateral members, in accordance with an embodiment of the present invention.
Figure 10A:
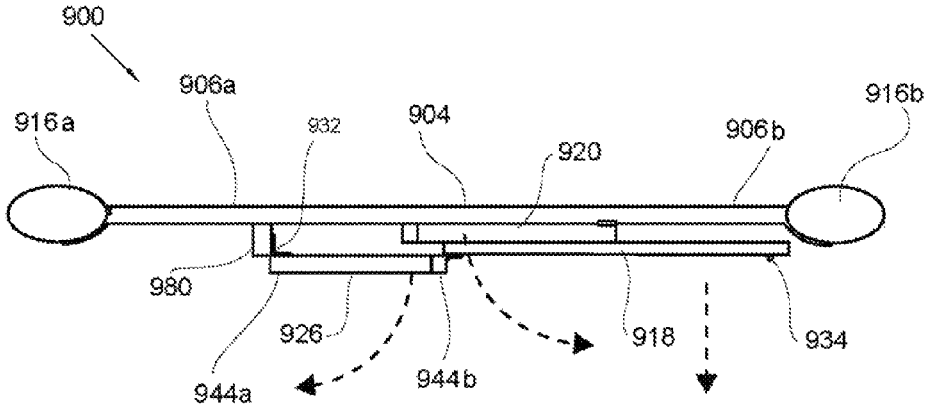
FIGS. 10A, 10B, 10C, and 10D illustrate a top view of an alternative embodiment of the multitier collapsible stand hingedly articulating from a collapsed position to an expanded position, in accordance with an embodiment of the present invention, in accordance with an embodiment of the present invention.
Figure 10B:
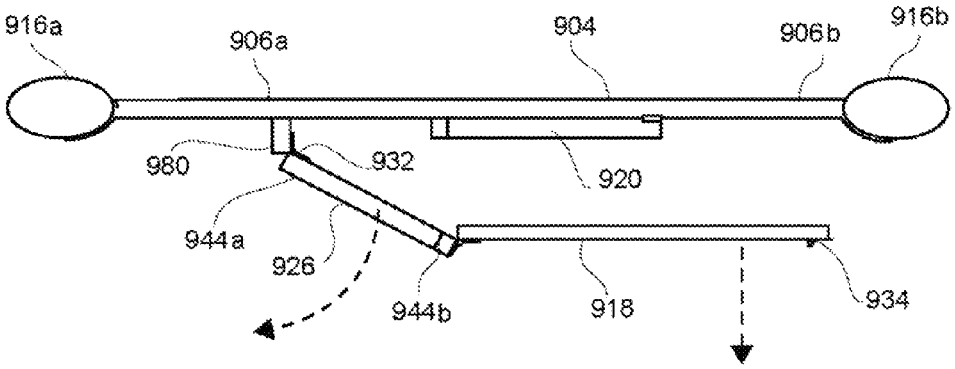
Figure 10C:
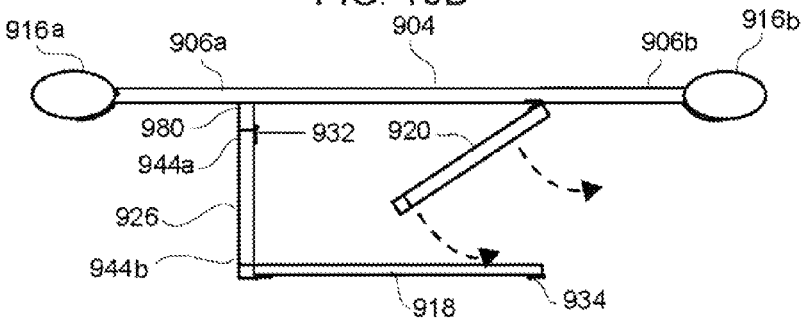
Figure 10D:
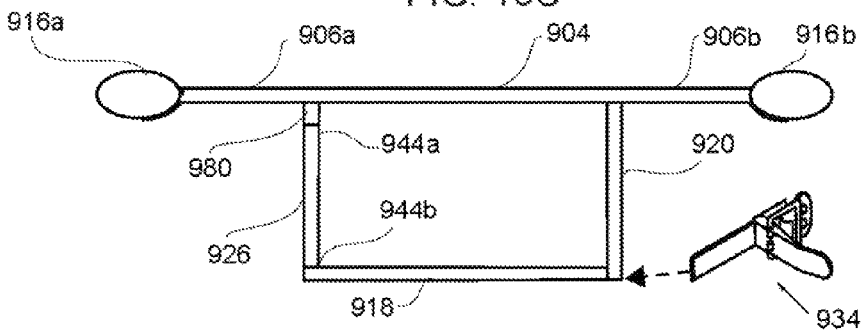

FIG. 9 illustrates a perspective view of an alternative embodiment of the multitier collapsible stand 900. In this alternative embodiment, the stand 900 is similar to the above in that a support frame 902 provides the base for the stand 900. The support frame 902 may include a pair of cross bars 916*a*, 916*b*. Each cross bar 916*a*, 916*b* fixedly attaches in a generally perpendicular disposition to a respective end of a first arm 904, a second arm 908, and a third arm 912.

However, the alternative embodiment of the stand 900 further includes a first extension member 980, a second extension member 982, and a third extension member 984 that extend generally perpendicularly between their respective arms 904, 908, 912 and respective right lateral members 926, 928, 930. Each right lateral member 926, 928, 930 hingedly articulates about its respective extension member 980, 982, 984 in relation to the arms 904, 908, 912. In this manner, the extension members 902, 904, 906 serve to create greater clearance for the arms 904, 908, 912 while hinging about the respective right lateral members 926, 928, 930. The extension members 902, 904, 906 also increase the depth of the stand 900, so as to accommodate larger objects, i.e., televisions. The length of the extension members 902, 904, 906 may vary. In one embodiment, the extension members 902, 904, 906 are about 6 inches long.

As referenced in FIGS. 10A, 10B, 10C, and 10D, the first extension member 980 is configured to extend from at least one of the pair of first ends 906*a*, 906*b* of the first arm 904. The first extension member 980 forms a fixed relationship with the first arm 904, and specifically the right end 906*a* of the first arm 904. The first extension member 980 also forms a fixed, generally perpendicular relationship with the first right lateral member 926.

However, in other embodiments, the first extension member 980 may extend from the left end 906*b* of the first arm 904 and the first left lateral member 920. In yet other embodiments, the first extension member 980 may extend from both the right and left ends 906*a*, 906*b* of the first arm 904 and the first right and left lateral members 926, 920.

In some embodiments, the first right lateral member 926 comprises a first right arm end 944*a* and a first right panel end 944*b*. The first right arm end 944*a* is configured to hingedly engage the first extension member 980. In this manner, the first extension member 980 forms a fulcrum for pivotal articulation of the first right lateral member 926 about the first arm 904. And as above, the first right panel end 944*b* hingedly engages a rear panel 918. A hinge 932 joins the first right arm end 944*a* is configured to hingedly join the first extension member 980.

In some embodiments, the second extension member 982 is configured to extend from at least one of the pair of second ends 910*a*, 910*b* of the second arm. The second extension member 982 forms a fixed, generally perpendicular relationship with the second arm 908, and specifically the right end 910*a* of the second arm 908. The second extension member 982 also forms a fixed, generally perpendicular relationship with the second right lateral member 928. However, in other embodiments, the second extension member 982 may extend from the left end 910*b* of the second arm 908 and the second left lateral member 922.

In some embodiments, the second right lateral member 928 comprises a second right arm end 946*a* and a second right panel end 946*b*. The second right arm end 946*a* is configured to hingedly engage the second extension member 982. In this manner, the second extension member 982 forms a fulcrum for pivotal articulation of the second right lateral member 928 about the second arm 904. And as above, the second right panel end 946*b* hingedly engages the rear panel 918. A hinge 932 that joins with the second right arm end 946*a* is configured to hingedly engage the second extension member 982.

In some embodiments, the third extension member 984 is configured to extend from at least one of the pair of third ends 914*a*, 914*b* of the third arm 912. The third extension member 984 forms a fixed relationship with the third arm 912, and specifically the right end 914*a* of the third arm 912. The third extension member 984 also forms a fixed, generally perpendicular relationship with the third right lateral member 930. However, in other embodiments, the third extension member 984 may extend from the left end 914*b* of the third arm 912 and the third left lateral member 924.

In some embodiments, the third right lateral member 930 comprises a third right arm end 948*a* and a third right panel end 948*b*. The third right arm end 948*a* is configured to hingedly engage the third extension member 984. In this manner, the third extension member 984 forms a fulcrum for pivotal articulation of the third right lateral member 930 about the third arm 912. And as above, the third right panel end 948*b* hingedly engages the rear panel 918. A hinge 932 joins the third right arm end 948*a* is configured to hingedly engage the third extension member 984. Furthermore, as described below, a buckle hinge 934 may also be used to enable both hinged articulation and detachability between the rear panel 918 and the left lateral members 920, 922, 924.

Figure 5C:
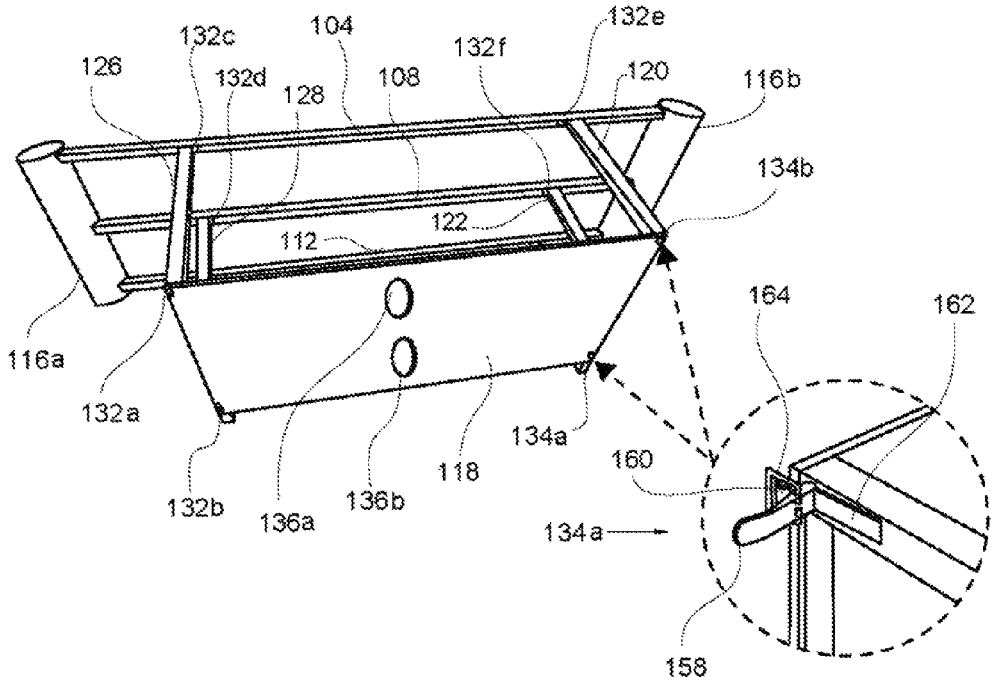

As referenced in the blow up view of FIG. 5C, at least one buckle hinge 134*a-b* provides unique interconnectivity between the arms 104, 108, 112, the lateral members 120, 122, 124, 126, 128, 130, and the rear panel 118 by forming both hinged and detachable connections therebetween. In one possible embodiment, the buckle hinge 134*a-b* enables both hinged articulation and detachability between the various components of the support frame 102. Specifically, the buckle hinge 134*a-b* is used to fasten, connect, and pivot multiple sections of the support frame 102 relative to each other. The buckle hinge 134*a-b* segments into two sections through a buckling mechanism. In this manner, separation and pivoting is possible by the lateral members 120, 122, 124, 126, 128, 130 and the rear panel 118 of the support frame 102.

FIG. 5C illustrates how the buckle hinge 134*a-b* hingedly connecting the rear panel 118 with the lateral members 120, 122, 124, 126, 128, 130. The first buckle 134*a* hinge hingedly connects the rear panel 118 with the first left panel end 138*b*. The second buckle hinge 134*b* hingedly connects the rear panel 118 with the second left panel end 140*b*. The third buckle 134*c* hinge hingedly connects the rear panel 118 with the third left panel end 142*b*. In addition to the hinging function, the buckle hinge 134*a-b* is further configured to enable detachment of the rear panel 118 from the first left panel end 138*b*, the second left panel end 140*b*, and the third left panel end 142*b*. Thus, detachment of the rear panel 118 from the first left panel end 138*b*, the second left panel end 140*b*, and the third left panel end 142*b* through the at least one buckle hinge 134*a-b* enables hinged manipulations for collapsing the stand 100. In one embodiment, the buckle hinge 134*a-b* pivots up to 90°.

This unique capacity of the buckle hinge 134*a*, 134*b* to both hingedly pivot and separate is possible because of a buckling mechanism. Specifically, the buckle hinge 134*a-b* is defined by a lip 164 and a latching member. The latching member comprises a mounting panel 162, a lever 158, and a catch 160. The lever 158 is configured to pivotally engage the catch to the lip, wherein the lip 164 and the latching member detach and fasten through selective manipulation of the lever 158.

In operation, the lever 158 is configured to pivot on the fulcrum selectively, to and from the lip 164, such that the catch 160 engages and disengages from the lip 164. Once the catch 160 clasps onto the generally protruding lip 164, a force is applied to the lever 158 away from the lip 164 to forcibly clamp the respective sections of the support frame 102 together. The direction of the lever 158 may then be reversed to disengage the catch 160 from the lip 164, and thereby enable separation of the respective sections of the support frame 102.

In one exemplary embodiment, the lip 164 is attached to the rear panel 118, and the latching member is fastened to the first left lateral member 120. The latching member pivotally fastens and detaches from the lip 164 in a secure but adjustable manner. The lever 158 of the latching member is configured to pivot on a fulcrum to pivotally articulate the catch 160 and engage the lip 164. In this manner, the lip 164 catches and holds the latching member for detachable fastening.

Figure 6A:
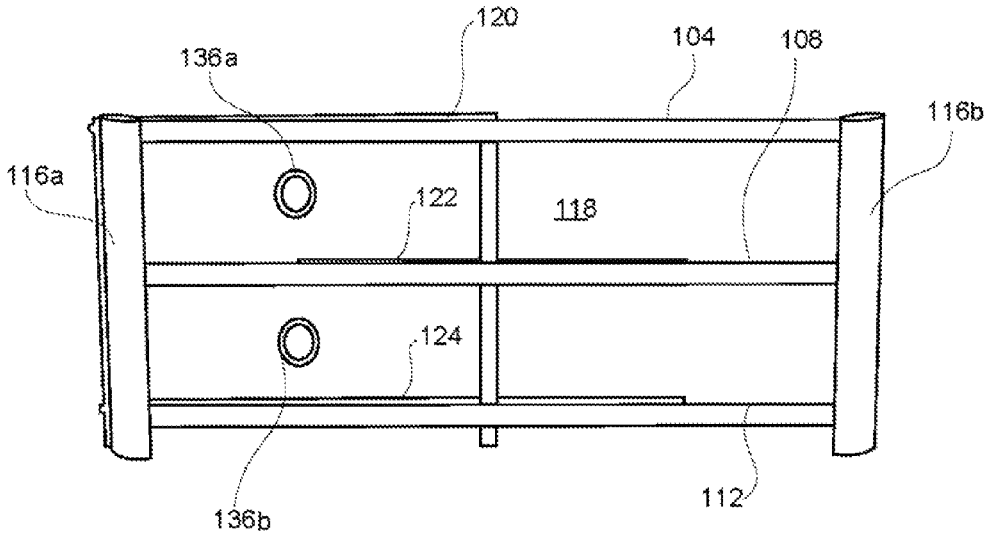
FIGS. 6A and 6B illustrate a perspective view of the multitier collapsible stand articulating in a collapsed position, in accordance with an embodiment of the present invention.
Figure 6B:
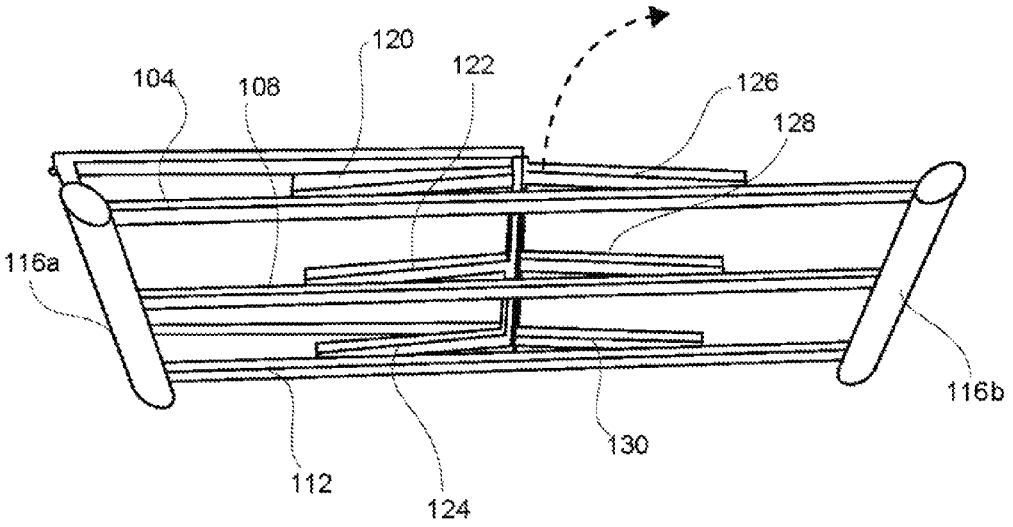
Figure 7A:
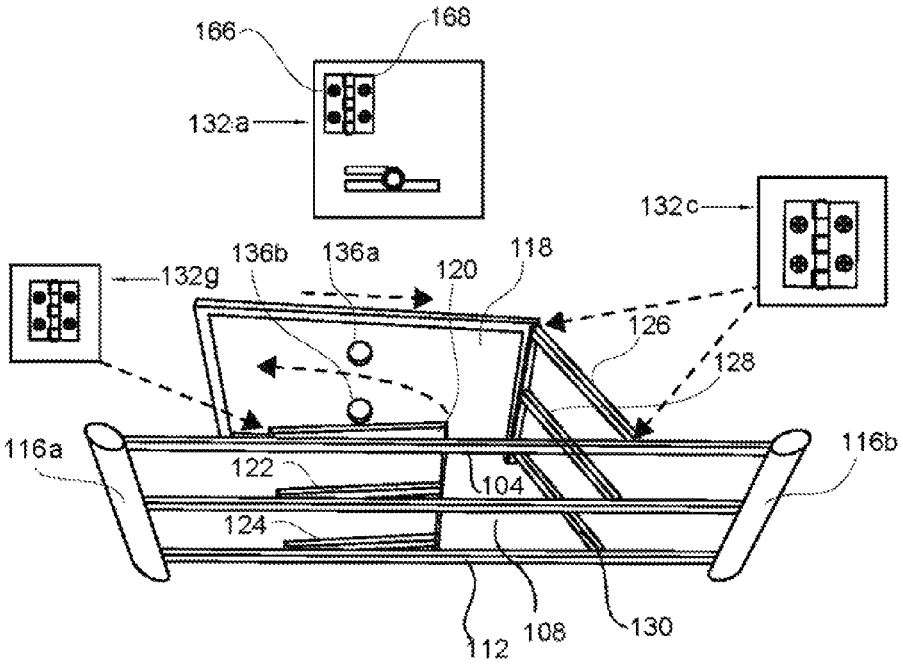
FIGS. 7A and 7B illustrate a perspective view of the multitier collapsible stand articulating towards the expanded position, in accordance with an embodiment of the present invention.
Figure 7B:
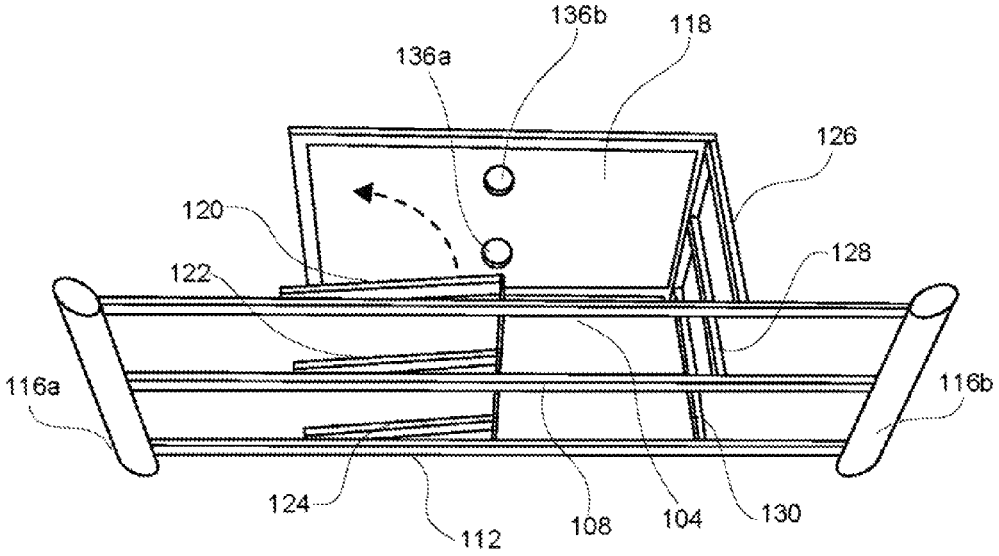

The operation of collapsing the stand 100 involves hinged articulations and separations between the buckle hinge 134*a-b*. For example, FIGS. 6A and 6B illustrate a perspective view of the stand 100 articulating in a collapsed position; FIGS. 7A and 7B illustrate a perspective view of the stand 100 articulating towards the expanded position; and FIGS. 8A and 8B illustrate a perspective view of the stand 100 articulating in the fully expanded position. The first step involves manipulating the buckle hinge 134*a-b* to separate the rear panel 118 from the first left panel end 138*b*, the second left panel end 140*b*, and the third left panel end 142*b*. The hinges 132*a-f* at the arms 104, 108, 112 and lateral members 120, 122, 124, 126, 128, 130 may then be folded inwardly to create the collapsed, substantially flat configuration of the support frame 102. The support frame 102 is unfolded to an expanded position by unfolding the arms 104, 108, 112 and lateral members 120, 122, 124, 126, 128, 130, and attaching the rear panel 118 with the respective panel ends 136*b*, 138*b*, 140*b* through the buckle hinge 134*a-b*.

Thus, the stand 100 is specially configured so that the arms 104, 108, 112, cross bars 116*a*, 116*b*, lateral members 120, 122, 124, 126, 128, 130, and rear panel 118 are hingedly and detachably connected together so that they may be quickly assembled and also disassembled and returned to the collapsed position for further storage or shipment.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A multitier collapsible stand for supporting an object on multiple tiers and facilitated collapsibility, the stand comprising:

a support frame, the support frame comprising:

a first arm, the first arm defined by a pair of first ends;

a second arm, the second arm defined by a pair of second ends;

a third arm, the third arm defined by a pair of third ends, wherein the first arm, the second arm, and the third arm are disposed in a generally horizontal, spaced-apart relationship;

a pair of cross bars, each cross bar attached in a generally perpendicular disposition to a respective end of the first arm, the second arm, and the third arm;

a rear panel, the rear panel disposed in a generally coplanar relationship with the first arm, the second arm, and the third arm;

a first extension member, the first extension member configured to extend from at least one of the pair of first ends of the first arm;

a second extension member, the second extension member configured to extend from at least one of the pair of second ends of the second arm;

a third extension member, the third extension member configured to extend from at least one of the pair of third ends of the third arm;

a first left lateral member, the first left lateral member comprising a first left arm end and a first left panel end, the first left arm end configured to hingedly engage the first arm, the first left panel end configured to hingedly engage the rear panel;

a second left lateral member, the second left lateral member comprising a second left arm end and a second left panel end, the second left arm end configured to hingedly engage the second arm, the second left panel end configured to hingedly engage the rear panel;

a third left lateral member, the third left lateral member comprising a third left arm end and a third left panel end, the third left arm end configured to hingedly engage the third arm, the third left panel end configured to hingedly engage the rear panel;

a first right lateral member, the first right lateral member comprising a first right arm end and a first right panel end, the first right arm end configured to hingedly engage the first extension member, the first right panel end configured to hingedly engage the rear panel;

a second right lateral member, the second right lateral member comprising a second right arm end and a second right panel end, the second right arm end configured to hingedly engage the second extension member, the second right panel end configured to hingedly engage the rear panel;

a third right lateral member, the third right lateral member comprising a third right arm end and a third right panel end, the third right arm end configured to hingedly engage the third extension member, the third right panel end configured to hingedly engage the rear panel;

a first support panel, the first support panel disposed to position across the first left lateral support member and the first right lateral support member;

a second support panel, the second support panel disposed to position across the second left lateral support member and the second right lateral support member;

a third support panel, the third support panel disposed to position across the third left lateral support member and the third right lateral support member, wherein each left lateral member and each right lateral member carries at least one of the support panels, wherein the first support panel, the second support panel, and the third support panel are disposed in a stacked, spaced-apart relationship;

seven hinges, the seven hinges defined by a first hinge side configured to pivotally join with a second hinge side, the seven hinges including: a first hinge, a second hinge, a third hinge, a fourth hinge, a fifth hinge, a sixth hinge, and a seventh hinge, the first hinge configured to hingedly connect the first arm with the first left arm end, the second hinge configured to hingedly connect the second arm with the second left arm end, the third hinge configured to hingedly connect the third arm with the third left arm end, the fourth hinge configured to hingedly connect the first arm with the first right arm end, the fifth hinge configured to hingedly connect the second arm with the second right arm end, the sixth hinge configured to hingedly connect the third arm with the third right arm end, the seventh hinge configured to hingedly connect the rear panel with the first right arm end, the seventh hinge further configured to hingedly connect the rear panel with the second right arm end, the seventh hinge further configured to hingedly connect the rear panel with the third right arm end; and three buckle hinges, the three buckle hinges including a first buckle hinge, a second buckle hinge, and a third buckle hinge, the three buckle hinges defined by a lip and a latching member, the latching member having a mounting panel, a lever, and a catch, the lever configured to pivotally engage the catch to the lip, wherein the lip and the latching member detachably fasten, the first buckle hinge configured to hingedly connect the rear panel with the first left panel end, the second buckle hinge configured to hingedly connect the rear panel with the second left panel end, and the third buckle hinge configured to hingedly connect the rear panel with the third left panel end, the three buckle hinges configured to enable detachment of the rear panel from the first left panel end, the second left panel end, and the third left panel end, wherein detachment of the rear panel from the first left panel end, the second left panel end, and the third left panel end through the three buckle hinges enable hinged manipulations for collapsing the stand.

2. The stand of claim 1, wherein the first extension member is disposed in a generally fixed, perpendicular relationship with the first arm and the first right lateral member.

3. The stand of claim 1, wherein the second extension member is disposed in a generally fixed, perpendicular relationship with the second arm and the second right lateral member.

4. The stand of claim 1, wherein the third extension member is disposed in a generally fixed, perpendicular relationship with the third arm and the third right lateral member.

5. The stand of claim 1, wherein the three buckle hinges enable pivoting up to ninety degrees.

6. The stand of claim 1, wherein the seven hinges enable pivoting up to ninety degrees.

7. The stand of claim 1, wherein the first arm, the second arm, and the third arm are generally flat and elongated.

8. The stand of claim 1, further including a plurality of spacers, the plurality of spacers disposed to position along the length of the left lateral members and the right lateral members, the plurality of spacers configured to enable dampening of a force applied to the first support panel, the second support panel, and the third support panel.

* * * * *